US008561799B2

(12) United States Patent
Kapla et al.

(10) Patent No.: US 8,561,799 B2
(45) Date of Patent: Oct. 22, 2013

(54) NESTABLE CONTAINER

(75) Inventors: John Paul Kapla, Brooklyn, NY (US); Kyle L. Baltz, Rossmoor, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 75 days.

(21) Appl. No.: 13/222,506

(22) Filed: Aug. 31, 2011

(65) Prior Publication Data

US 2012/0048767 A1 Mar. 1, 2012

Related U.S. Application Data

(60) Provisional application No. 61/379,360, filed on Sep. 1, 2010.

(51) Int. Cl.
*B65D 21/06* (2006.01)

(52) U.S. Cl.
USPC ..... 206/506

(58) Field of Classification Search
CPC ..... B65D 21/06
USPC ..... 206/506
See application file for complete search history.

(56) References Cited

U.S. PATENT DOCUMENTS 4,391,369 A * 7/1983 Stahl et al. ..... 206/506
6,145,664 A 11/2000 Cope
7,234,599 B2 6/2007 Hassell et al.
7,581,641 B2 9/2009 Hassell et al.
2005/0263423 A1 12/2005 Hassell et al.
2006/0065567 A1 3/2006 Hassell et al.
2006/0231449 A1 10/2006 Hassell et al.
2012/0048767 A1 3/2012 Kapla

FOREIGN PATENT DOCUMENTS

GB 2362378 11/2001
JP 2005126076 A 5/2005

OTHER PUBLICATIONS

European Extended Search Report for EP 11179788 mailed on Oct. 7, 2011.
U.S. Appl. No. 13/222,106, Non-Final Office Action mailed Mar. 11, 2013.

* cited by examiner

*Primary Examiner* — Stephen Castellano
(74) *Attorney, Agent, or Firm* — Carlson, Gaskey & Olds

(57) ABSTRACT

A nestable container includes a base wall and a pair of side walls and a pair of end walls extending upward from the base wall. The walls are nestable within side walls and end walls of an identical container. The container includes one or more supports, each having a pair of support arms extending from a support bar. The support is movable between a nesting position where the support bar is outward of the base wall, a high stack position where the support bar is a first height over the base wall, and a low stack position where the support bar is a second height over the base wall. The support bar is not directly supported on the side walls when the support is in the high stack position. The support bar is supported on the side walls at a point spaced away from the support bar.

20 Claims, 10 Drawing Sheets

NESTABLE CONTAINER

This application claims priority to U.S. Provisional Application Ser. No. 61/379,360, filed Sep. 1, 2010.

BACKGROUND

Nestable containers or trays with pivotable support arms are well known. Generally, the trays are nestable within one another when empty for efficient storage and shipping. A pair of supports or bails can be pivoted to a position over the floor of the tray so that a similar tray can be supported thereon. In this manner trays can be stacked when there are goods stored in the trays.

Some trays having supports that are movable to more than one height, so that the trays can be stacked more efficiently when they are only partially full. In some of these multi-height trays, the supports are only supported on a single thickness wall, which may not be sufficient under a stack of fully-loaded trays. This is particularly true for multi-height trays where the supporting portion of the wall is undercut or cantilevered somewhat to provide a lower supporting portion vertically aligned with the upper supporting portion.

SUMMARY

A nestable container includes a base wall and a pair of side walls and a pair of end walls extending upward from the base wall. The walls are nestable within side walls and end walls of an identical container.

The container includes one or more supports, each having a pair of support arms extending from a support bar. The support is movable between a nesting position where the support bar is outward of the base wall to permit nesting, a high stack position where the support bar is a first height over the base wall to permit stacking, and a low stack position where the support bar is a second height over the base wall to permit stacking. The support bar is not directly supported on the side walls when the support is in the high stack position.

The support bar is supported on the side walls at a point spaced away from the support bar. This permits the support bar to be supported at multiple heights without an undercut under a support surface on the side wall, but with the support bar still being received in an elongated recess on the underside of the base at both positions.

DETAILED DESCRIPTION OF A PREFERRED EMBODIMENT

Figure 1:
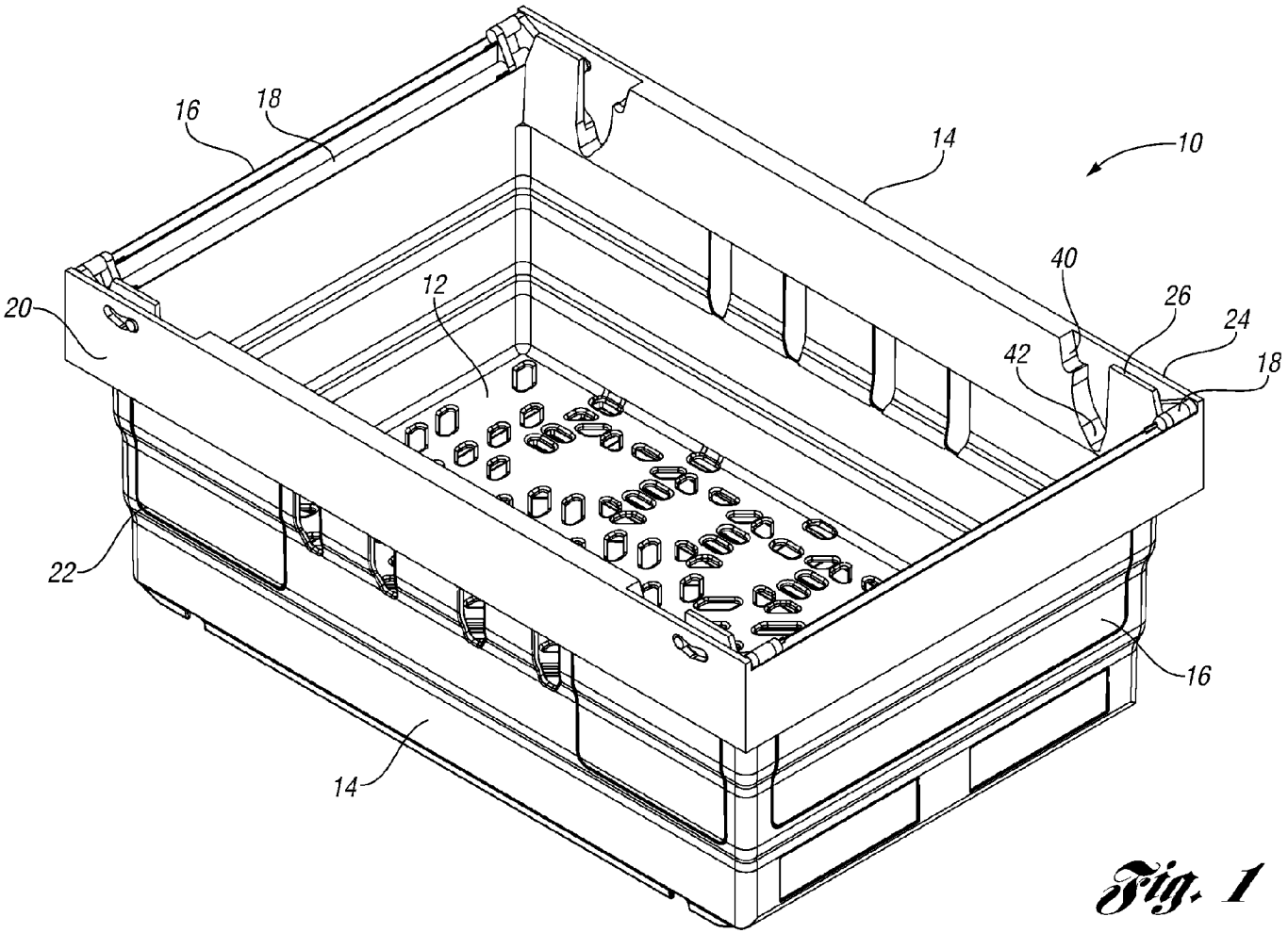
FIG. 1 is a perspective view of a container according to one embodiment of the present invention.

A nestable container 10 according to one embodiment is shown in FIG. 1. The container 10 generally includes a base wall 12, opposed side walls 14 and opposed end walls 16. A support 18 (or bail) is pivotably and slidably mounted to the side walls 14 adjacent each end wall 16. The side walls 14 and end walls 16 each include an upper wall portion 20 and a lower wall portion 22. The upper wall portions 20 of the side walls 14 each include an outer wall portion 24 and an inner wall portion 26, spaced inwardly from the outer wall portion 24. The outer wall portion 24 is spaced outwardly of the lower wall portion 22 to form a lip along the periphery of the container 10.

An upper support surface 40 is formed in the inner wall portion 22 adjacent each end wall 16. A lower support surface 42 is formed between each upper support surface 40 and the closest end wall 16. Unlike many prior art designs, the upper support surface 40 is not cantilevered over the lower support surface 42. This improves the strength of the portion of the wall near the upper support surface 40.

Figure 12:
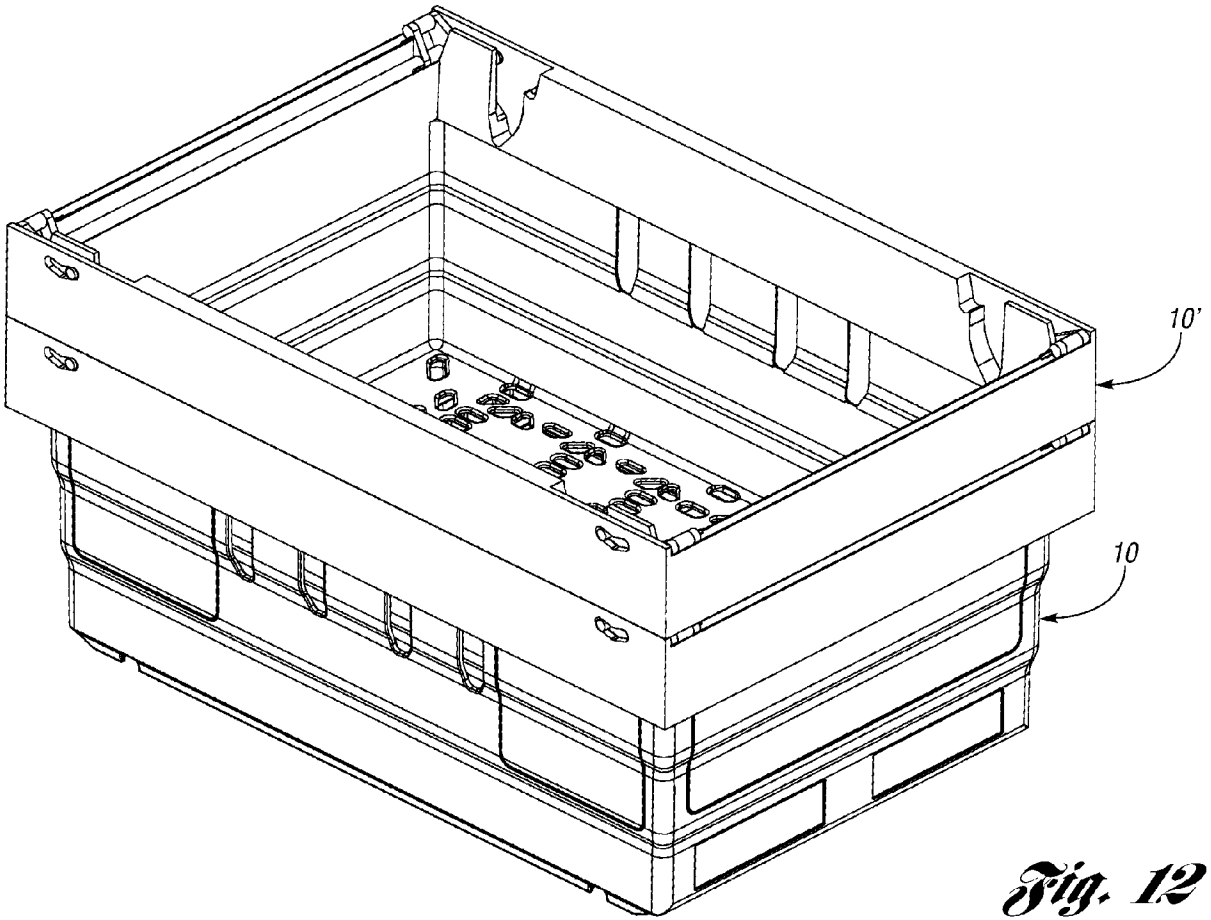
FIG. 12 is a perspective view of the tray of FIG. 1 with an identical tray nested therein.

The support 18 is pivotable and slidable among a plurality of positions, including the home/nest position shown in FIG. 1. As shown in FIG. 12, in the home/nest position, an identical container 10' can be nested fully in the container 10 (i.e. the lower wall portion of the upper container is fully or nearly fully received within the side walls 14 and end walls 16 of the lower container 10).

Figures 2, 3, 4:
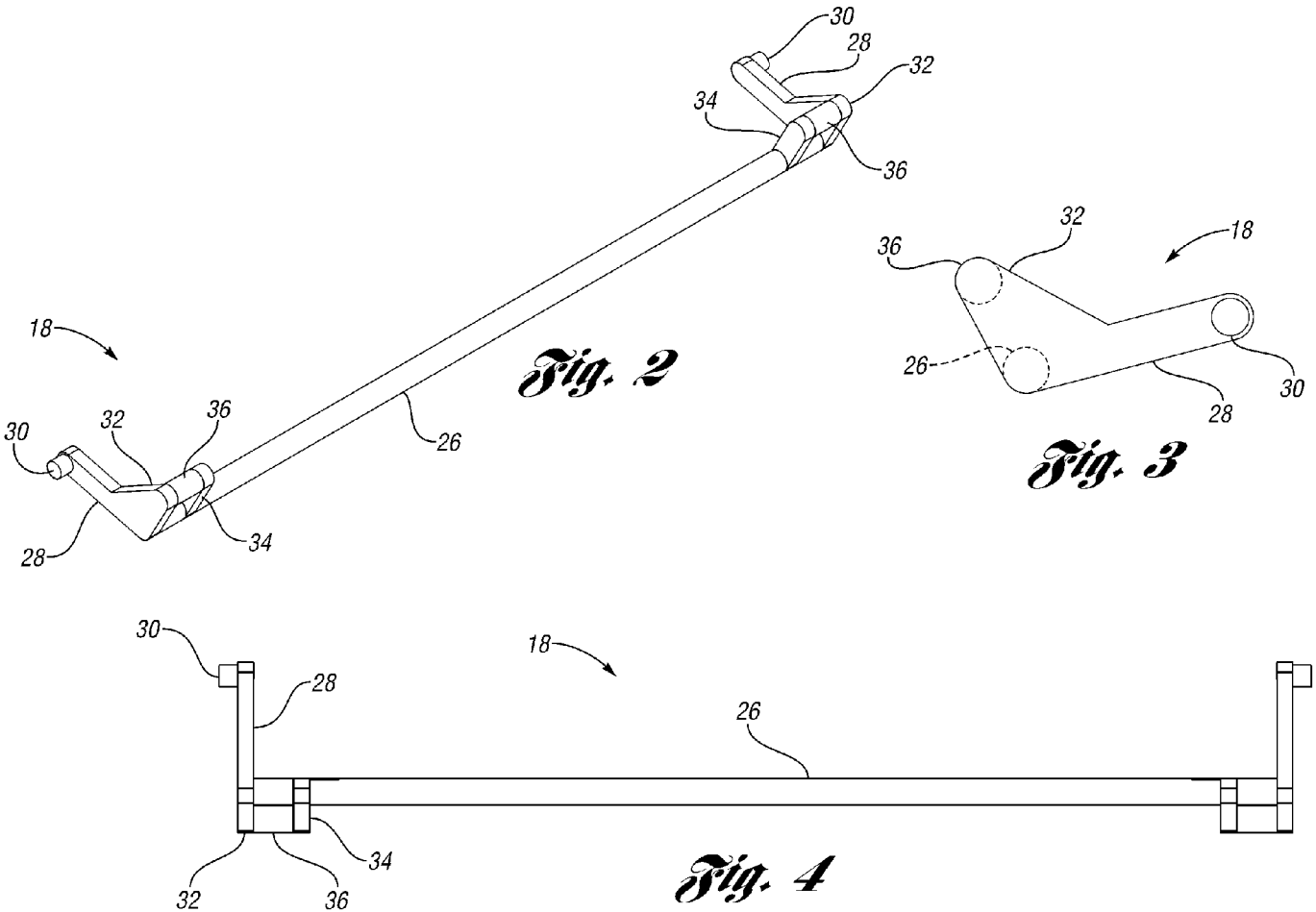
FIG. 2 is a perspective view of one of the supports of FIG. 1.
FIG. 3 is an end view of the support of FIG. 2.
FIG. 4 is a front view of the support of FIG. 2.

The support 18 is shown in more detail in FIGS. 2-4. As shown, the support 18 includes a support bar 26 connected at each end to one end of a support arm 28. The opposite end of each support arm 28 includes a pivot pin 30 protruding outwardly and a projecting portion 32 projecting laterally relative to the support arm 28 and the support bar 26. An offset bar 36 projects inwardly from the end of each projecting portion generally parallel to the support bar 26. A second arm 34 extends from the support bar 26 to the inner end of the offset bar 36.

Figure 5:
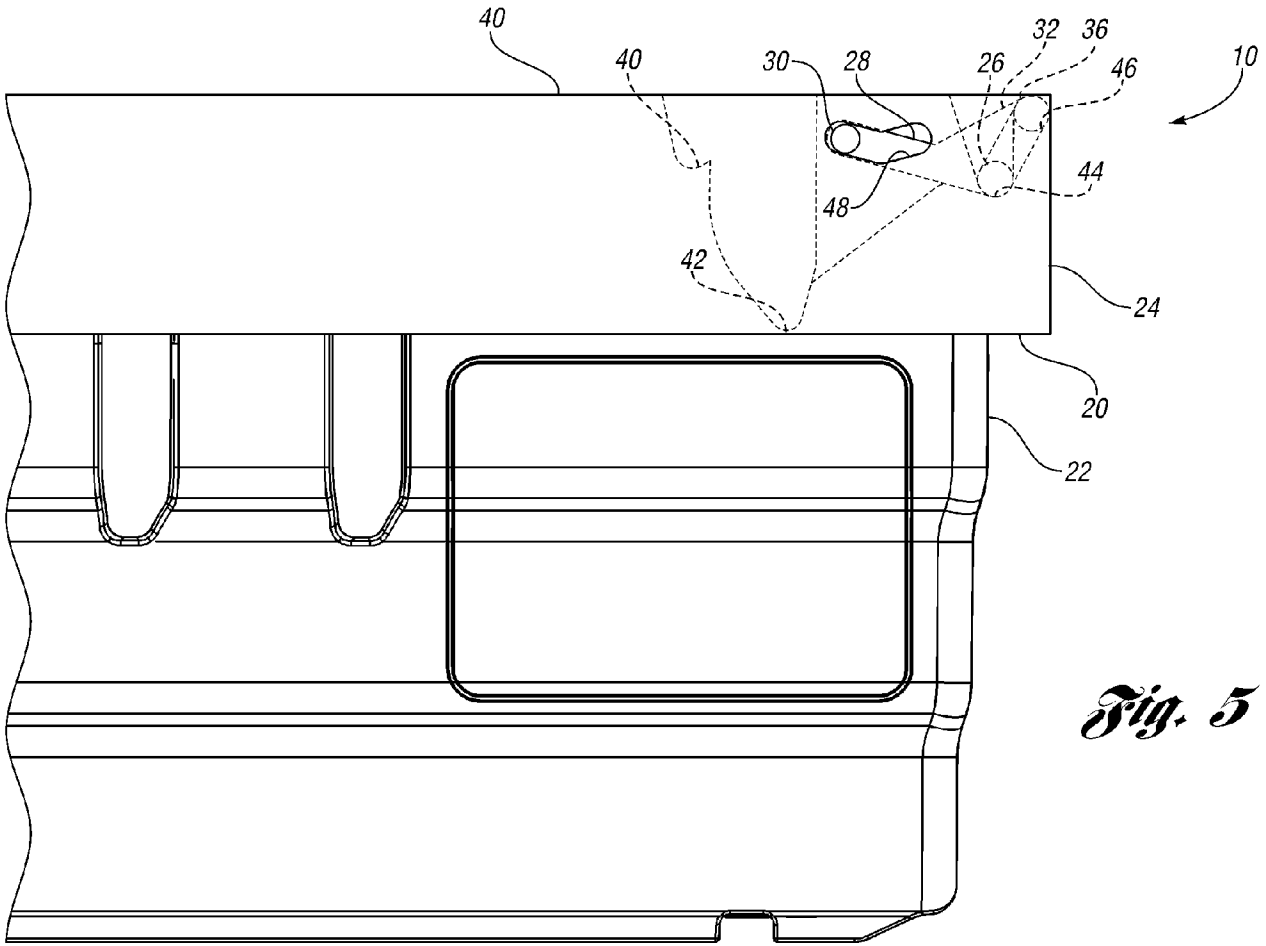
FIG. 5 is a side view, partially broken away of the tray of FIG. 1.

As shown in FIG. 5, each pivot pin 30 is slidably and pivotably received in a wide V-shaped opening 48 in the outer wall portion 24. In FIG. 5, the support 18 is shown in the nest or "home" position. In the home position, the support bar 26 is received on lower outer support surfaces 44 and the offset bars 36 on upper outer support surfaces 46. In this position, the hinge pins 30 are slid to an innermost position in the opening 48.

Figure 6:
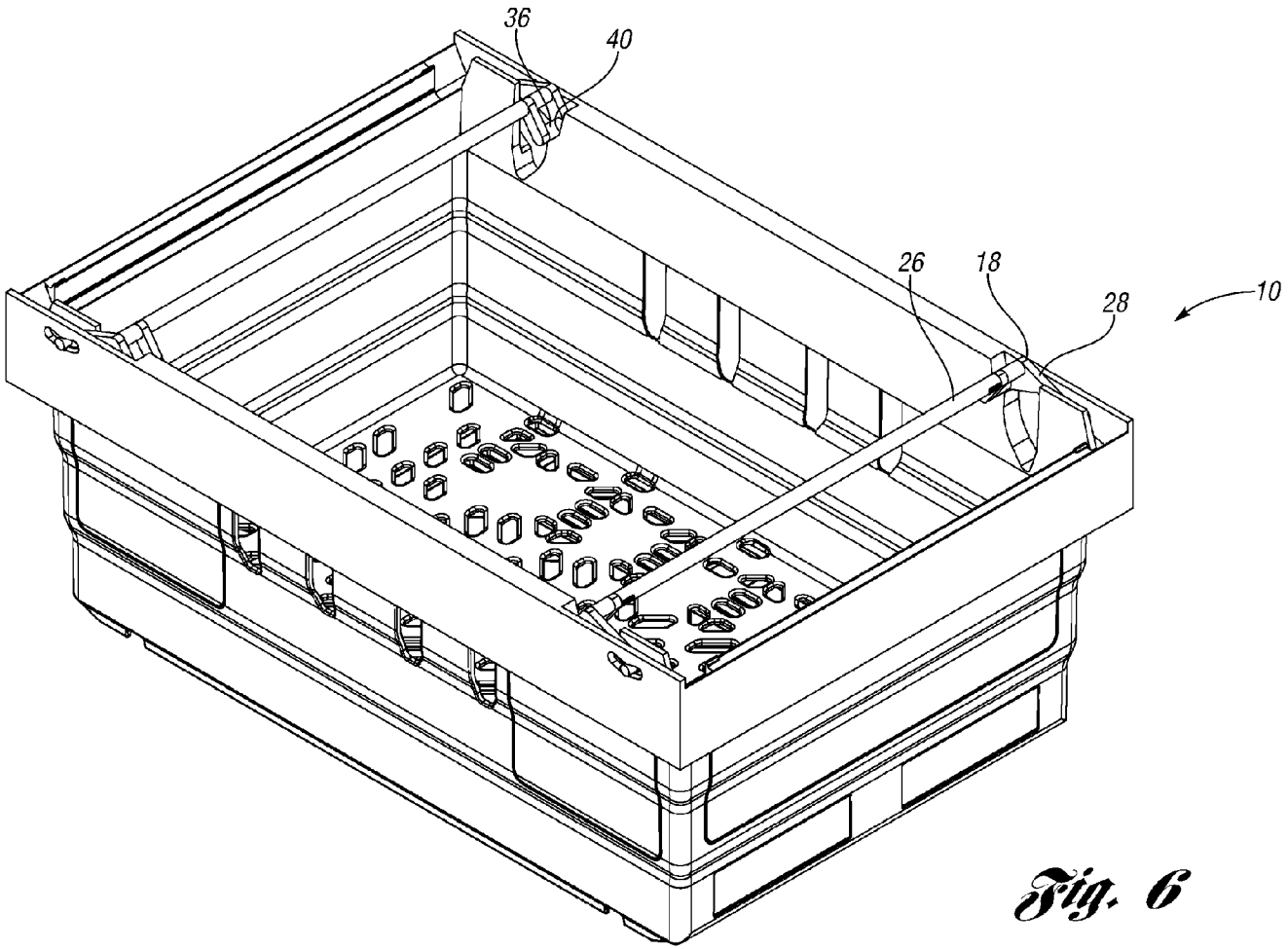
FIG. 6 is a perspective view of the tray of FIG. 1 with the supports in a high stack position.
Figure 7:
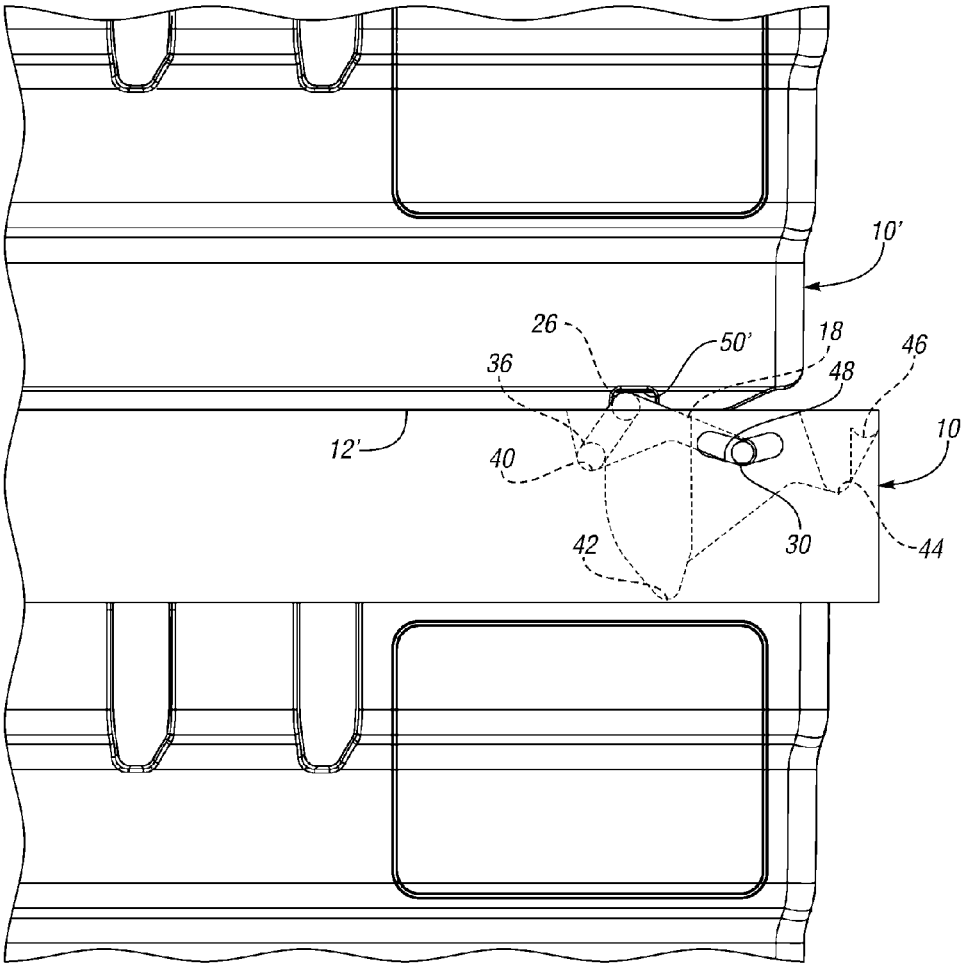
FIG. 7 is a side view, partially broken away, of the tray of FIG. 6 with an identical tray stacked thereon.

In FIGS. 6 and 7, the support 18 is pivoted and slid to a high stack position. Referring to FIG. 7, the offset bars 36 and projecting portions 32 are received on the upper support surfaces 40 and the pivot pins 30 are slid to a mid/low-point of the V-shaped opening 48. As shown in FIG. 7, when an identical container 10' is stacked on the support bars 26 of the container 10, the support bar 26 is received in a lower channel 50' in an underside of the base 12', generally toward an interior side of the channel 50. In this position, the base 12' of the upper container 10' is at a maximum distance from the base 12 of the lower container 10, thus providing the most volume for goods within the container 10. The weight of the upper container 10' and its contents is distributed by the support 18 to both the upper support surfaces 40 and the bottom edge of the V-shaped opening 48.

Figure 8:
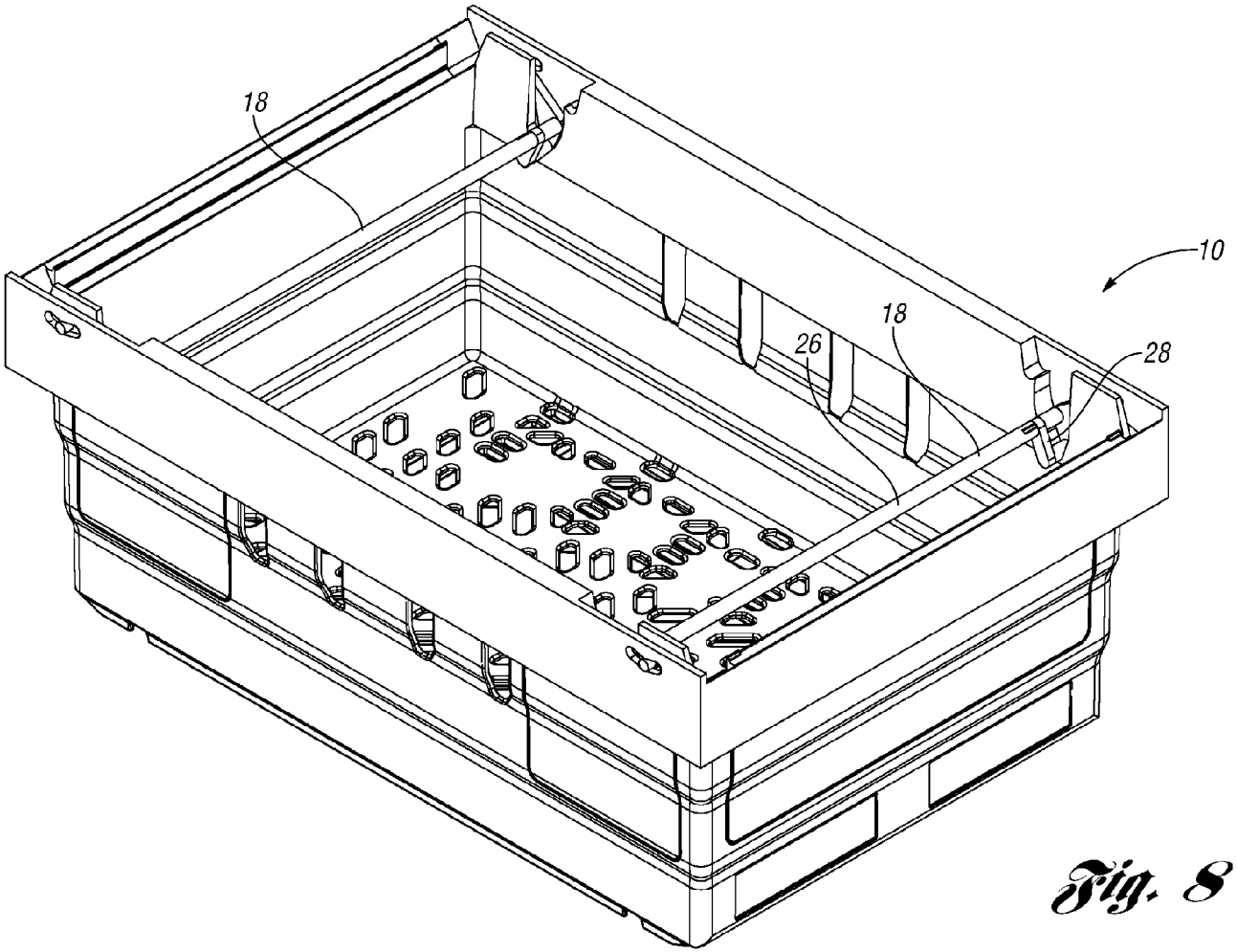
FIG. 8 is a perspective view of the tray of FIG. 1 with the supports in a low stack position.
Figure 9:
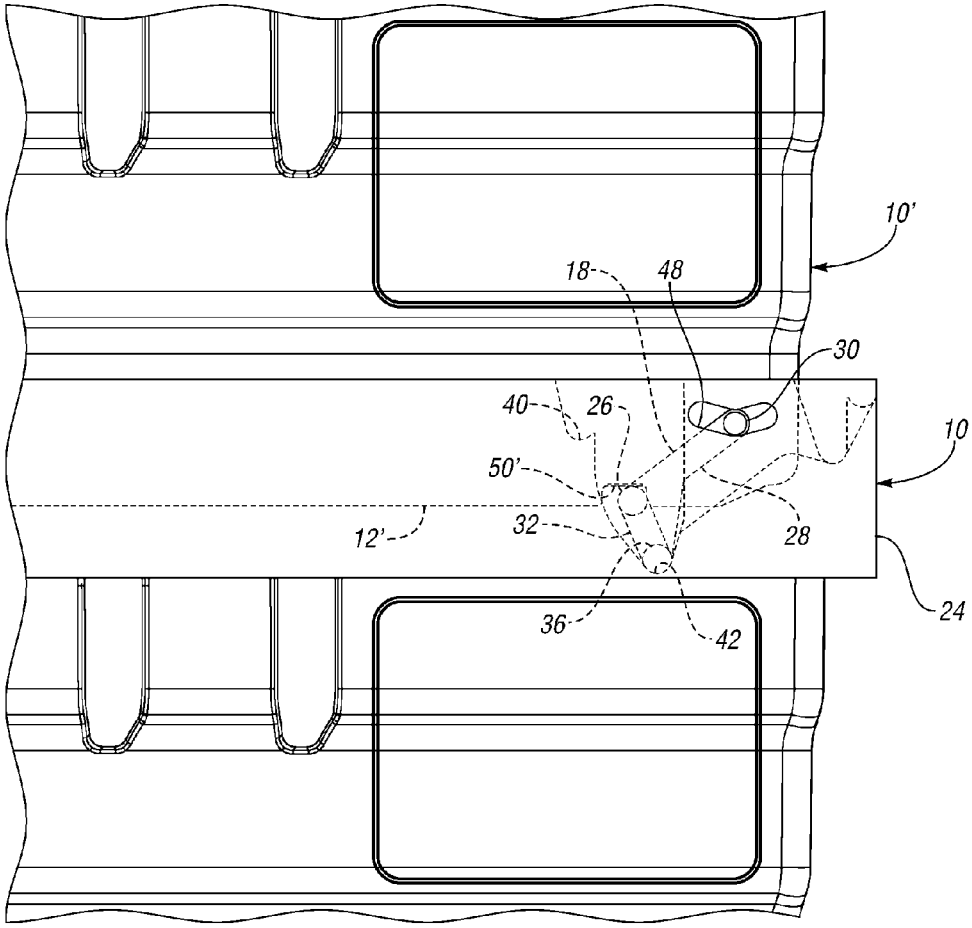
FIG. 9 is a side view, partially broken away, of the tray of FIG. 8 with an identical tray stacked thereon.

In FIGS. 8 and 9, the supports 18 are moved to a low stack position. Referring to FIG. 9, the offset bars 36 are supported on the lower support surfaces 42, while the pivot pins 30 are supported by the lower edges of the V-shaped openings 48 in the outer wall portions 24. Again, the support bar 26 is received in the channel 50' of the upper container 10', although toward an exterior edge of the channel 50'. The weight of the upper container 10' and its contents is distributed to both the lower support surface 42 and the lower edge of the V-shaped opening 48. In the low stack position, the volume for storage in the lower container 10 is reduced, so that smaller items can be shipped or stored in containers 10 efficiently.

Figure 10:
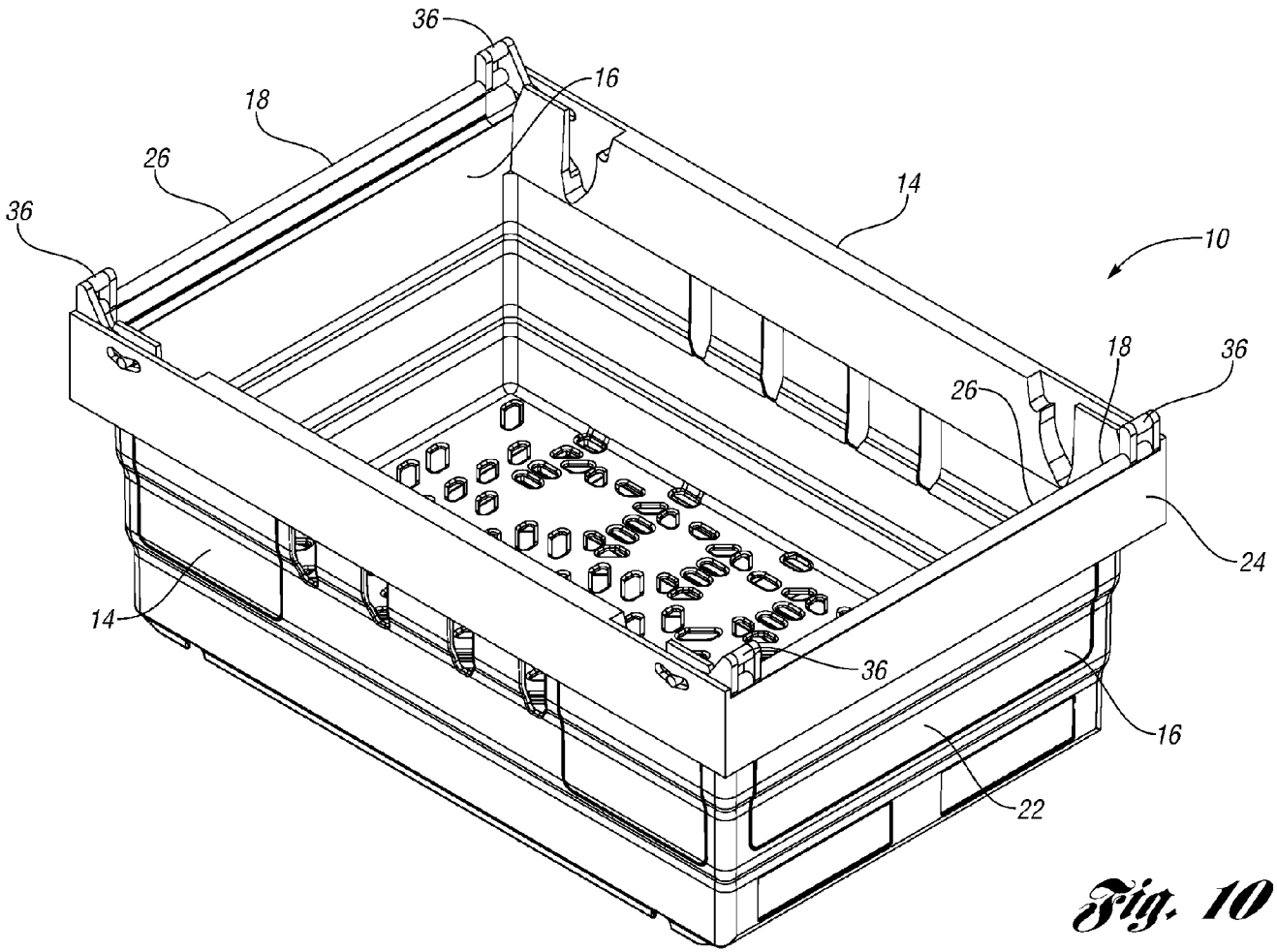
FIG. 10 is a perspective view of the tray of FIG. 1 with the supports in a high nest position.
Figure 11:
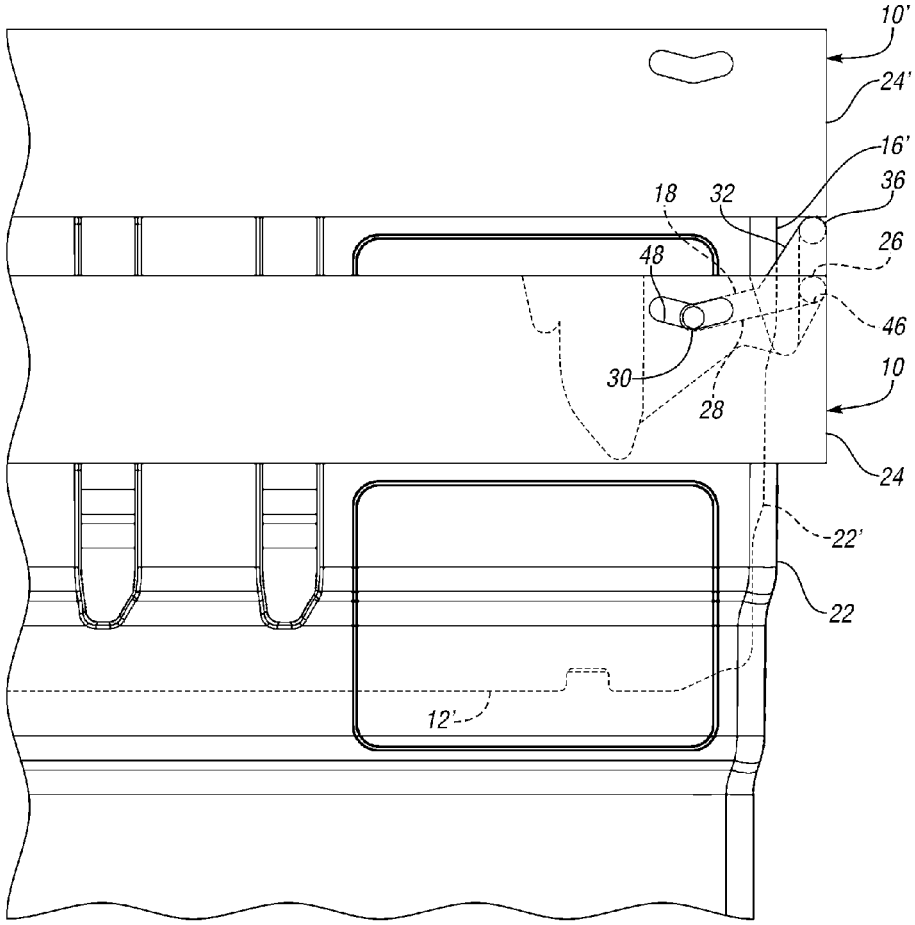
FIG. 11 is a side view, partially broken away, of the tray of FIG. 10 with an identical tray stacked thereon.

FIGS. 10 and 11 show the supports 18 pivoted and slid to a high nest position in which the offset bars 36 project upward above an uppermost edge of the side walls 14 and end walls 16. The offset bars 36 are generally vertically aligned outward of the lower wall portions 22 of the end walls 16. Referring to FIG. 11, in the high nest position, the support bars 26 are received in the upper outer support surfaces 46 and the pivot pins 30 are supported on the lower edge of the V-shaped openings 48. Most of the weight of the upper container 10' and its contents is transferred directly through the offset bars 36, the projecting portions 32 and the support bars 26 to the end walls 16 of the lower container 10. In the high nest position, the lower wall portion 22' of the upper container 10' is received substantially but not entirely within the side walls 14 and end walls 16. The offset bars 36 support the upper container 10' below the peripheral lip portion of the end walls 16' of the upper container 10'. In this position, the base wall 12' of the upper container 10' is spaced above the base wall 12 of the lower container 10 by a distance less than in the high stack or low stack positions, but more than in the nest/home position. Thus, small items can be efficiently shipped and stored in a plurality of containers 10 arranged in such a manner.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A nestable container comprising:

a base wall;

a pair of side walls and a pair of end walls extending upward from the base wall, the base wall, side walls and end walls nestable within side walls and end walls of an identical container; and a support having a pair of support arms extending from a support bar, the support bar extending from one of the pair of support arms to the other of the pair of support arms, each support arm including a projecting portion, the support movable between a nesting position where the support bar is outward of the base wall to permit nesting and a stack position where the support bar is over the base wall to permit stacking, wherein each projecting portion is directly supported on the side walls when the support is in the stack position, wherein the support is movable to a high nest position where the support bar is outward of the base wall and the projecting portions of the support arms are vertically aligned with upper outer support surfaces outward of the end walls, such that an identical container nested in the container would be supported on the projecting portions of the support at a high nest height higher than the nest height.

2. The nestable container of claim 1 wherein the stack position is a high stack position and wherein the support is also movable to a low stack position in which the support bar is at a lower height than in the high stack position, wherein each projecting portion is directly supported on the side walls but the support bar is not directly supported on the side walls when the support is in the low stack position.

3. The nestable container of claim 2 wherein the support bar in the high stack position is vertically aligned with a recess in an underside of the base wall and wherein the support bar in the low stack position is vertically aligned with the recess in the underside of the base wall.

4. The nestable container of claim 3 wherein the support is also directly supported on the side walls at pivot pins that are slidably and pivotably connected to the side walls.

5. The nestable container of claim 3 wherein the support is supported on an upper support surface of the side wall in the high stack position and the support is supported on a lower support surface of the side wall in the low stack position and wherein the upper support surface is not cantilevered over the lower support surface.

6. The nestable container of claim 5 wherein the upper support surface is offset relative to the lower support surface toward a center of the container.

7. The nestable container of claim 1 wherein the support includes an offset bar projecting laterally from each of the projecting portions.

8. The nestable container of claim 7 wherein the support arm is a first arm and wherein the support includes a second arm extending from the support bar to an inner end of each of the offset bars.

9. The nestable container of claim 1 wherein the support is also directly supported on the side walls at pivot pins that are slidably and pivotably connected to the side walls.

10. The nestable container of claim 1 wherein the support is also directly supported on the side walls at pivot pins that are connected to the side walls, wherein the support in the stack position is supported on the side wall only on the projecting portions and on the pivot pins.

11. The nestable container of claim 1 wherein the support bar is not directly supported on the side walls when the support is in the stack position.

12. A nestable container comprising:

a base wall;

a pair of side walls and a pair of end walls extending upward from the base wall, the base wall, side walls and end walls nestable within side walls and end walls of an identical container; and a support having a pair of support arms extending from a support bar, the support movable between a nesting position where the support bar is outward of the base wall to permit nesting, a high stack position where the support bar is a first height over the base wall to permit stacking, and a low stack position where the support bar is a second height over the base wall to permit stacking, wherein the support is supported on an upper support surface of the side wall in the high stack position and the support is supported on a lower support surface of the side wall in the low stack position and wherein the upper support surface is not cantilevered over the lower support surface.

13. The nestable container of claim 12 wherein the support is supported on the side walls at a point offset away from a nearer one of the end walls relative to the support bar when the support is in the high stack position.

14. The nestable container of claim 13 wherein the support is supported on the side walls at a point offset toward a nearer one of the end walls relative to the support bar when the support is in the low stack position.

15. The nestable container of claim 12 wherein the support bar is not directly supported on the side walls when the support is in the low stack position.

16. The nestable container of claim 12 wherein the support is movable to a high nest position in which the support contacts upper outer contact surfaces outward of the end wall of an identical container nested thereo.

17. The nestable container of claim 12 wherein the support is also directly supported on the side walls at pivot pins that are slidably and pivotably connected to the side walls.

18. A nestable container comprising:

a base wall;

a pair of side walls and a pair of end walls extending upward from the base wall, the base wall, side walls and end walls nestable within side walls and end walls of an identical container; and a support having a pair of support arms extending from a support bar, the support bar extending from one of the pair of support arms to the other of the pair of support arms, each support arm including a projecting portion, the support movable between a nesting position where the support bar is outward of the base wall to permit nesting and a stack position where the support bar is over the base wall to permit stacking, wherein each projecting portion is directly supported on the side walls when the support is in the stack position, wherein the support is also directly supported on the side walls at pivot pins that are connected to the side walls, each arm having its pivot pin closer to the support bar than to the projecting portion.

19. The nestable container of claim 18 wherein in the stack position the projecting portion of each arm is supported on an upper support surface of the respective side wall and the upper support surface is toward a center of the container relative to the pivot pin and relative to the support bar.

20. The nestable container of claim 18 wherein the support bar is not directly supported on the side walls when the support is in the stack position.

* * * * *